United States Patent [19]

Sugiyama et al.

[11] Patent Number: 4,788,908

[45] Date of Patent: Dec. 6, 1988

[54] AUTOMATIC RELEASE TIMING CONTROL SYSTEM

[75] Inventors: Yoshio Sugiyama; Yoshimi Kozuka, both of Nagoya, Japan

[73] Assignee: Kabushiki Kaisha Sugiyama Denki Seisakusho, Nagoya, Japan

[21] Appl. No.: 50,577

[22] Filed: May 18, 1987

[30] Foreign Application Priority Data

May 21, 1986 [JP] Japan ..... 61-117973

[51] Int. Cl.[4] ..... B30B 15/14; B30B 3/04

[52] U.S. Cl. ..... 100/47; 226/33; 226/154

[58] Field of Search ..... 100/47, 214, 215, 216; 226/154, 33, 34, 35, 155

[56] References Cited

U.S. PATENT DOCUMENTS 3,115,999 12/1963 Wythe ..... 226/154 X
3,797,720 3/1974 Gaudion ..... 226/33
4,717,059 1/1988 Takahashi ..... 226/33 X

*Primary Examiner*—Peter Nerbun
*Attorney, Agent, or Firm*—Dennison, Meserole, Pollack & Scheiner

[57] ABSTRACT

An automatic release timing control system for use with a press and a cooperating feeder for feeding a web of sheet material wherein a sheet release timing and a sheet grip timing of a release mechanism in the feeder are corrected in response to the varying revolution of the press and the response time of the release mechanism, so that, even when the working speed of the press is high, the sheet releasing operation and the sheet gripping operation of the release mechanism can follow up the working speed of the press.

2 Claims, 4 Drawing Sheets

AUTOMATIC RELEASE TIMING CONTROL SYSTEM

BACKGROUND OF THE INVENTION

1. Field of the Invention

The present invention relates to an automatic release timing control system for use with a press which is adapted for producing a release control signal which causes a cooperating feeder to temporarily release the gripping of a sheet material at a proper timing, when pilot pins provided for accurately positioning the sheet material are inserted into pilot holes in the sheet material.

2. Description of the Prior Art

In a conventional press, a feeder for feeding a web of sheet material to the press, for example an independent NC feeder, is provided with an air-actuated release mechanism to temporarily release the gripping of the sheet material. The release mechanism generally includes an air solenoid valve and repeats cyclic operations in which, when the air solenoid valve receives a sheet release signal from a control circuit, the release mechanism effects a releasing operation to temporarily release the sheet material, so that pilot pins of the press can be accurately led into pilot holes in the sheet material. When the pilot pins are inserted into the pilot holes, a press working is performed, and thereafter, when a sheet grip signal is fed from the control circuit to the solenoid valve, the release mechanism terminates the releasing operation and grips the sheet material to feed the same to the press.

In such a conventional release mechanism for the feeder which repeats the cycle of releasing and gripping operation, the release and grip timings are constant, irrespective of the number of revolutions of the press, so that, when the revolution speed of the press is high, the allowable release time becomes short. Because of this fact along with the response time of the release mechanism, it becomes difficult for the release mechanism to follow up the working speed of the press.

SUMMARY OF THE INVENTION

It is a primary object of the present invention to eliminate the above disadvantage associated with the prior art by providing an automatic release timing control system in which the sheet release and sheet grip timings of a release mechanism in a sheet feeder are corrected in response to the varying revolution speed of the press and the response time of the release mechanism, so that, even when the working speed of the press is high, the sheet releasing operation and the sheet gripping operation of the release mechanism can follow up the working speed of the press.

According to the present invention, there is provided an automatic release timing control system for use with a press having pilot pins and a cooperating feeder adapted to feed a web of sheet material to the press and having a sheet release mechanism, the sheet material having pilot holes in which the pilot pins of the press are engageable. The automatic release timing control system comprises a rotary encoder for detecting the revolution of the press in operation and producing a signal indicative of the detected revolution; a sensor for detecting the operating position of the release mechanism of the feeder and producing signals indicative of a sheet releasing position and a sheet gripping position of the release mechanism; and a control circuit for controlling the timing at which the release mechanism temporarily releases the sheet material. When response times of the release mechanism are previously known, a response time setting device may be provided to fixedly set response times of the release mechanism in place of the operating position sensor for the release mechanism.

When the press is put in operation and the rotary encoder produces a signal, the control circuit calculates the revolution speed and the rotational angle of the press. When the rotational angle matches a predetermined release timing and a predetermined grip timing, the control circuit outputs a sheet release signal and a sheet grip signal to the release mechanism to bring the release mechanism in a sheet releasing position and a sheet gripping position, respectively, and it receives signals from the release mechanism operating position sensor which are indicative of the releasing position and the gripping position of the release mechanism, and calculates the response times at the releasing operation and the gripping operation of the release mechansim. In response to the above calculated revolution of the press and the response times of the releasing mechanism or fixedly preset response times of the releasing mechanism, the release timing and the grip timing are corrected, and the corrected timings are set as a release timing and a grip timing for the next cycle. If, in the next cycle, the rotational angle of the press matches the corrected release and grip timings, the control circuit outputs a sheet release signal and a sheet grip signal to the release mechanism.

Subsequently in the same way, the release timing and the grip timing corrected in response to the revolution speed of the press and the response time of the release mechanism in the present cycle are set as a release timing and a grip timing for the next cycle, and when the rotational angle of the press matches the set release and grip timings, a release signal and a grip signal are produced, so that the operation of the release mechanism can follow up the working speed of the press.

The invention will become more fully apparent from the claims and the description as it proceeds in connection with the drawings.

DETAILED DESCRIPTION OF A PREFERRED EMBODIMENT

Figure 1:
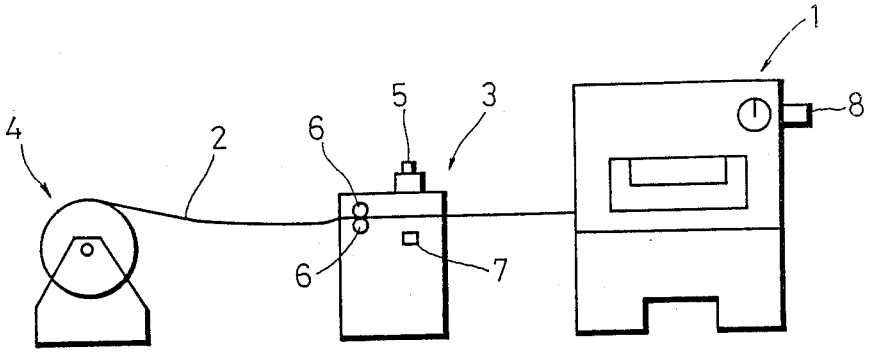
FIG. 1 is a schematic diagram illustrating the general arrangement in which the present invention is embodied.

Referring now to FIG. 1, shown therein and generally designated by the reference numeral 1 is a press for stamping a web of sheet material 2. The sheet 2 is fed to the press 1 by an NC feeder 3 serving as a feeding device. The sheet 2 is wound on an uncoiler 4 and, when the NC feeder 3 is actuated, the sheet 2 is unwound from the uncoiler 4 and is fed to the press 1. As the sheet 2 is fed from the NC feeder 3 to the press 1, it is punched by a suitable punch mechanism (not shown) to provide pilot holes for receiving pilot pins (not shown) of the press 1. The NC feeder 3 includes an air-actuable solenoid valve 5 which is operatively connected to a pair of feed rollers 6 for feeding the sheet 2. When an electric control circuit which will be described later produces a sheet release signal to the solenoid valve 5, the solenoid valve 5 is actuated to bring the feed rollers 6 in a sheet releasing position, so that the pilot pins can be accurately inserted into the pilot holes in the sheet 2. Conversely, when a sheet grip signal is applied, the solenoid valve 5 brings the feed rollers 6 in a sheet gripping position, that is, returns the feed rollers 6 to be rotated in pressure contact with the sheet 2.

The NC feeder 3 is further provided with a proximity switch 7 adapted for detecting the operating position of the solenoid valve 5, that is, whether the solenoid valve 5 actuates the feed rollers 6 in the sheet releasing position or in the sheet gripping position, and for producing a release position detecting signal or a grip position detecting signal each time the operating position of the feed rollers 6 is changed. The press 1 is further provided with a rotary encoder 8 adapted for producing pulse signals corresponding to the number of revolutions of a ram driving crank (hereinafter referred to as number of revolutions of the press) which rotates to move a ram (not shown) vertically between the upper dead center and the lower dead center.

Figure 2:
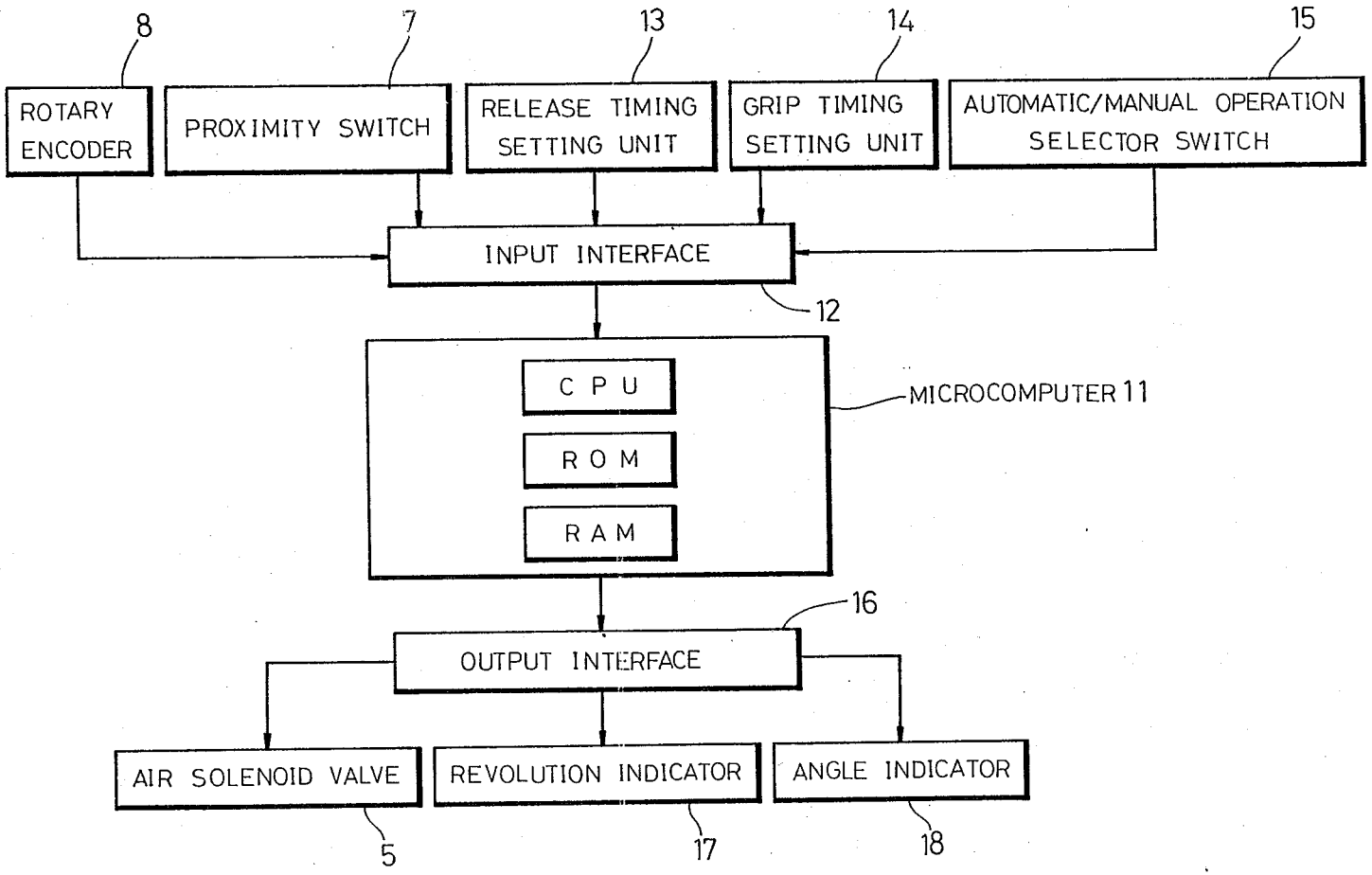
FIG. 2 is a block diagram of the control circuit.

Now, the electric control circuit will be described in detail. As shown in FIG. 2, the electric control circuit includes a microcomputer 11 serving as a central control unit, and an input interface 12 which is connected to an input port of the microcomputer 11. The rotary encoder 8 and the proximity switch 7 are connected to the input interface 12. The input interface 12 is also connected with a release timing setting unit 13 adapted for manually setting a reference timing for starting the sheet releasing operation in response to the rotational angle of the press 1 and, as necessary, a previously known response time for the releasing operation, and with a grip timing setting unit 14 adapted for manually setting a reference timing for starting the sheet gripping operation in response to the rotational angle and, as necessary, a previously known response time for the gripping operation. Each of the release timing setting unit 13 and the grip timing setting unit 14 is composed of, for example, a digital switch or a keyboard and a setting data display and others. The input interface 12 is further connected with an automatic/manual operation selector switch 15 adapted to select automatic control or manually set control of the sheet release timing of the NC feeder 3.

The microcomputer 11 has an output port connected to an output interface 16 which is connected to the solenoid valve 5, a revolution indicator 17 for indicating the number of revolutions of the press 1 calculated by the microcomputer 11, and an angle indicator 18 for indicting the rotational angle of the press 1. The microcomputer 11 is of a standard construction, incorporating a microprocessor CPU, a read only memory ROM and a random access memory RAM. A control program for automatically controlling the sheet release timing and the sheet grip timing is stored in the read only memory ROM.

Figure 4:
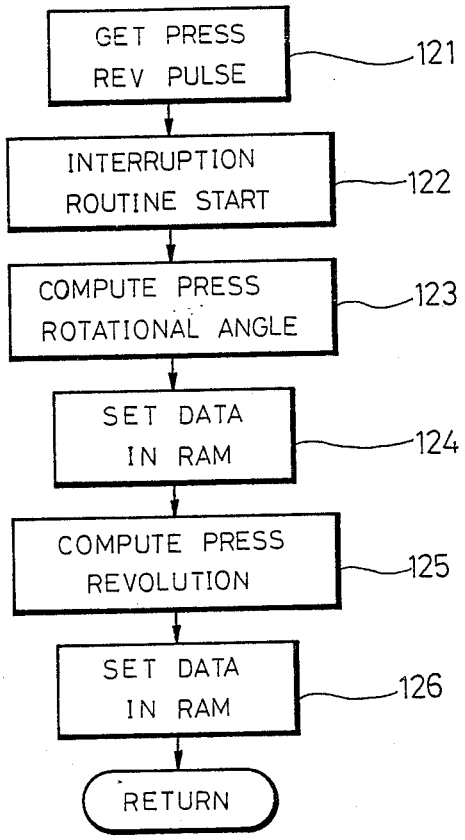
FIG. 4 is a flow chart illustrating the interruption routine.
Figure 3A:
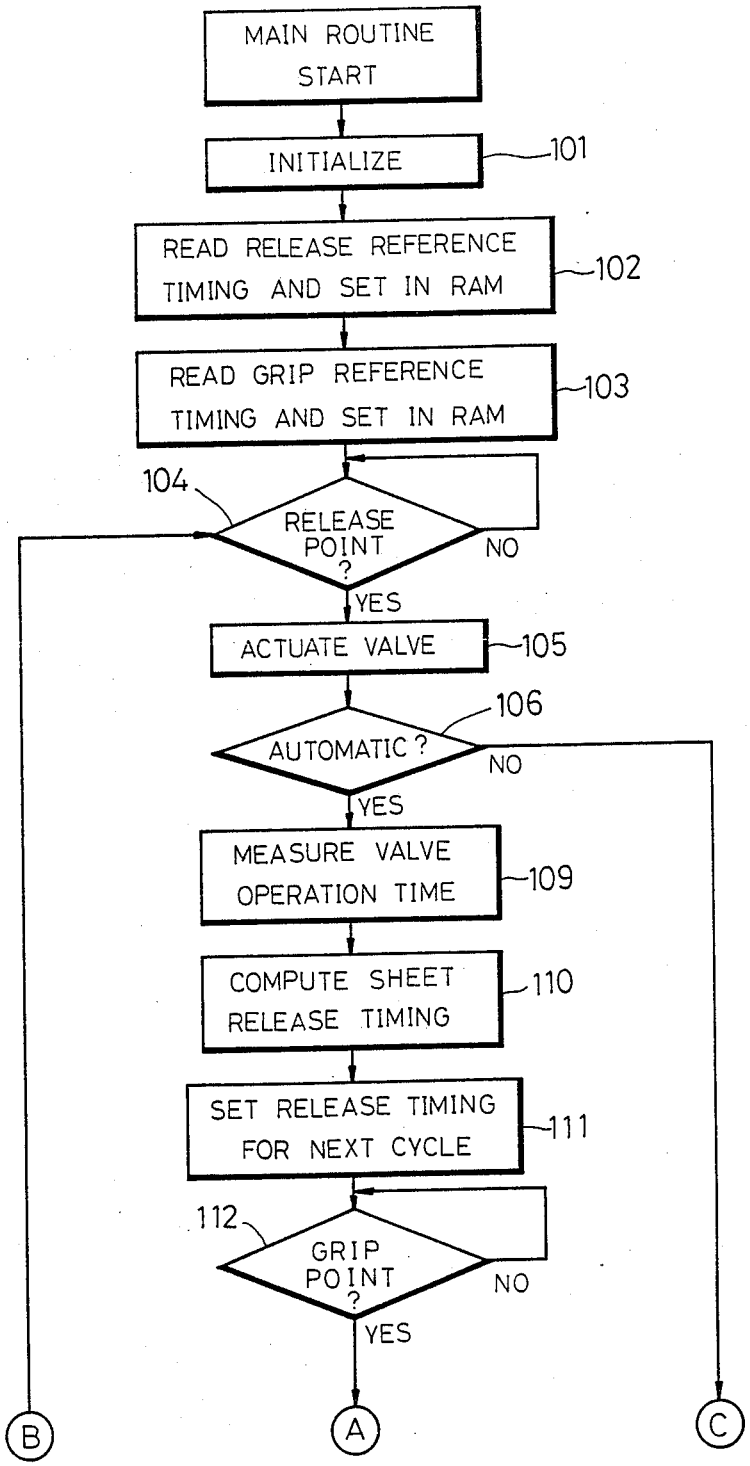
FIGS. 3A and 3B are flow charts illustrating the main control.
Figure 3B:
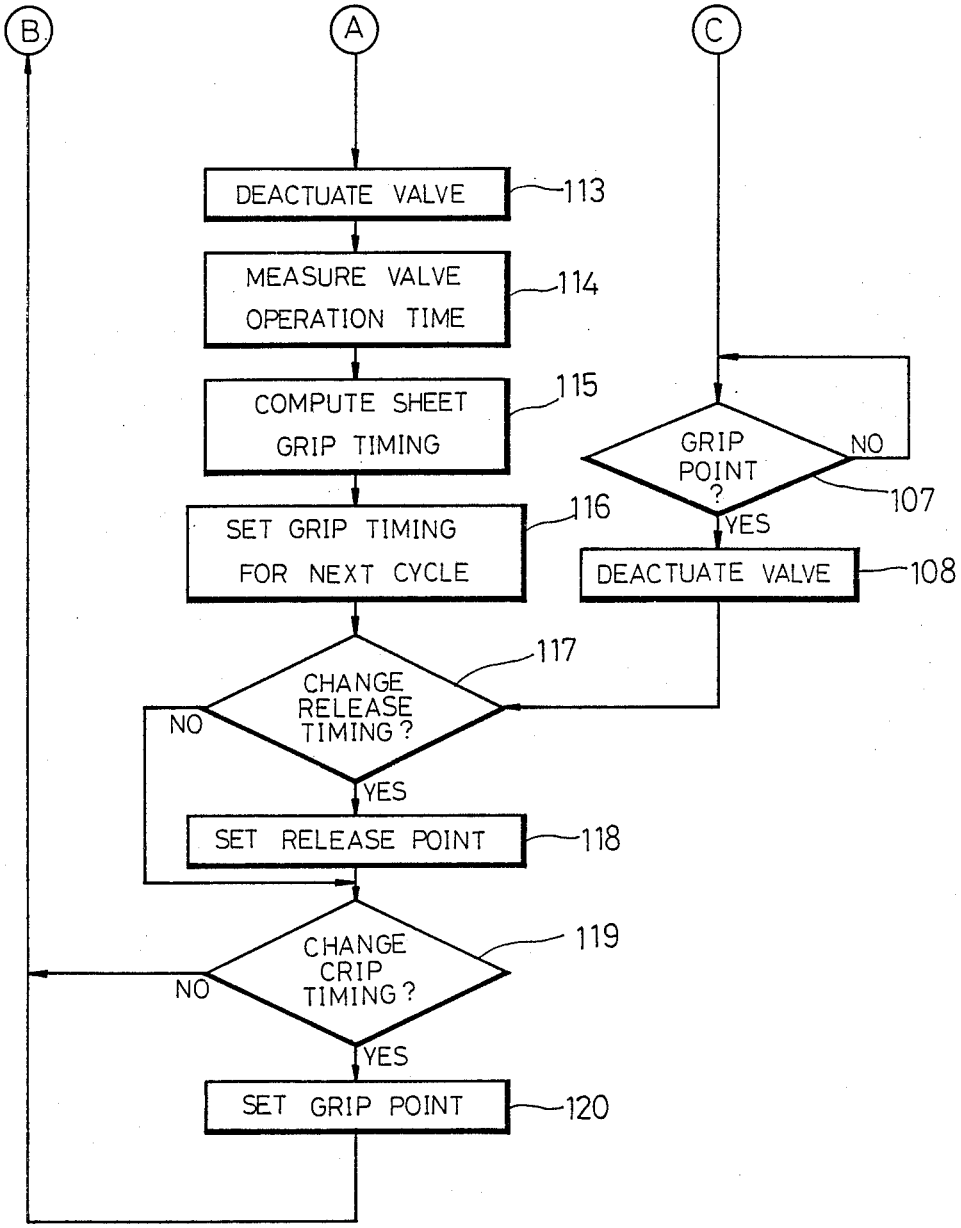

Now, the operation of the embodiment thus constructed will be described with reference to the control flow charts shown in FIGS. 3A, 3B and 4.

When the microcomputer 11 is supplied with electric power and initialized in Step 101, the microprocessor CPU reads out, in Step 102, the sheet release reference timing manually set by the release timing setting unit 13 and in Step 103, the sheet grip reference timing manually set by the grip timing setting unit 14, and they are set in the random access memory RAM. If, in Step 104, the microcomputer 11 determines that the rotational angle of the press 1 (corresponding to the position of the ram vertically moving between the upper dead center and the lower dead center) matches the sheet release reference timing set in Step 102 and that it is a point to produce a sheet release signal, the sheet release signal is applied to the solenoid valve 5 in Step 105. At this time, the sheet 2 is released from the feed rollers 6 and the pilot pins of the press 1 are inserted into the pilot holes in the sheet 2.

Then, when the microcomputer 11 determines in Step 106 that the automatic/manual operation selector switch 15 is set to the manual position, the microcomputer 11 determines in Step 107 if the rotational angle of the press 1 matches the sheet grip reference timing set by the grip timing setting unit 14, and when the microcomputer 11 determines the coincidence, a sheet grip signal is applied to the solenoid valve 5 to bring the feed rollers 6 of the NC feeder 3 in the sheet gripping position (Step 108).

When the microcomputer 11 determines in Step 106 that the automatic/manual operation selector switch 15 is set to the automatic position, the microcomputer 11 determines, in Step 109, the time interval from production of the sheet release signal in Step 105 to application of the release position detecting signal from the proximity switch 7, that is the response time of the solenoid valve 5 during the sheet releasing operation. When the response time during the releasing operation is manually set, the manually set response time is referred to.

Now, the description will be given as to the interruption routine flow chart shown in FIG. 4 which illustrates calculation of the rotational angle and the number of revolutions of the press 1.

When pulse signals responsive to the revolution speed of the press 1 are applied in Step 121 from the rotary encoder 8 mounted on the press 1 through the input interface 12 to the microprocessor CPU, the interruption routine is started in Step 122. In Step 123, the number of the pulse signals from the encoder 8 is counted to calculate the rotational angle of the press 1, and in Step 124, the rotational angle data of the press 1 is memorized in the random access memory RAM. Then, in Step 125, the interval of the pulse signals produced from the encoder 8 is measured to calculate the revolution speed of the press 1, and the revolution data of the press 1 is memorized in the random access memory RAM in Step 126. The above Steps 121 to 126 are executed as an interruption routine every time the pulse signals from the encoder 8 are applied to the microprocessor CPU.

Turning now to the main routine, Step 110 seq. will be described.

In Step 110, the microprocessor CPU calculates the sheet release timing according to the response time of the solenoid valve 5 measured and calculated in Step 109 and the revolution of the press 1 calculated in Step 125, and in Step 111, the sheet release timing is set in the random access memory RAM as release timing data for the next cycle. When the microcomputer 11 determines, in Step 112, that the rotational angle of the press 1 matches the sheet grip timing, a sheet gripping signal is applied to the solenoid valve 5 in Step 113. In Step 114, the microcomputer 11 calculates the time interval from production of the sheet gripping signal to application of the grip position detecting signal from the proximity switch 7, that is the response time of the solenoid valve 5 during the sheet gripping operation. When the response time during the gripping operation is manually set, the manually set response time is referred to. In Step 115, the sheet grip timing is calculated according to the response time during the gripping operation calculated and measured in Step 114 and the revolution speed of the press 1 calculated in Step 125, and the sheet grip timing is set in the random access memory RAM as grip timing data for the next cycle (Step 116).

If there is any change in setting of the sheet release timing and the sheet grip timing, setting of the respective timings is changed in Steps 117 to 120, and if there is no change in setting of the respective timings, the process returns to Step 104, and Steps 104 to 120 are repeated.

As described above, the microcomputer 11 corrects, at every cycle of the press 1, the sheet release timing and the sheet grip timing according to the revolution speed of the press 1 and to the response time of the release mechanism of the NC feeder 3 which is composed of the solenoid valve 5, the feed rollers 6, and other components, or to the manually set response time. Thus, the operation of the release mechanism can follow up the operation of the press 1, even when the number of revolutions of the press 1 is high.

Thus, since in the system of the present invention the operating timing of the release mechanism is corrected in response to the varying revolution of the press and the response time of the release mechanism, the operation of the release mechanism can follow up the operation of the press, even when the revolution speed of the press is high, so that the pilot pins can be accurately inserted into the pilot holes of the sheet material.

What is claimed is:

1. For use with a press having pilot pins and a feeder adapted to feed a web of sheet material to said press and having a part that revolves and a sheet release mechaism, said sheet material having pilot holes in which said pilot pins of said press are engageable, an automatic release timing control system for automatically controlling the timing at which, when said pilot pins of said press are inserted into said pilot holes of said sheet material, said feeder is activated to temporarily release its gripping of said sheet material at a time that is dependent on the revolution speed of said part of said press and the response times of said feeder, said automatic release timing control system comprising:

(a) a rotary encoder for detecting the revolution of said press in operation and for producing a signal indicative of the detected revolution;

(b) a sensor for detecting the operating position of said release mechanism of said feeder and for producing signals indicative of a sheet releasing position and a sheet gripping position of said release mechanism; and (c) a control circuit for controlling the timing at which said release mechanism of said feeder temporarily releases said sheet material, said control circuit including (1) first means for receiving a signal from said rotary encoder and for calculating the rotational angle of said press in operation;

(2) second means for receiving a signal from said rotary encoder and for calculating the revolution speed of said part of said press in operation;

(3) third means for outputting a sheet release signal and a sheet grip signal to said release mechanism when the rotational angle of said press matches a predetermined rotational angle corresponding to the sheet release timing of said release mechanism and a predetermined rotational angle corresponding to the sheet grip timing of said release mechanism, respectively;

(4) fourth means for receiving, from said sensor for detecting the operating position of said release mechanism, signals indicative of the releasing position and the gripping position of said release mechanism, and for calculating response times of said release mechanism during the releasing operation and the gripping operation, respectively;

(5) fifth means for correcting the sheet release timing and the sheet grip timing based upon the present revolution speed value calculated by said second means and upon the response times calculated by said fourth means;

(6) sixth means for setting a sheet release timing and a sheet grip timing for the next cycle of said press based upon the sheet release timing and the sheet grip timing corrected by said fifth means; and (7) seventh means for outputting a sheet release signal and a sheet grip signal to said release mechanism when the rotational angle of said press matches a predetermined rotational angle corresponding to the sheet release timing set by said sixth means and a predetermined rotational angle corresponding to the sheet grip timing set by said sixth means.

2. For use with a press having a pilot pins and a feeder adapted to feed a web of sheet material to said press and having a part that revolves and a sheet release mechanism, said sheet material having pilot holes in which said pilot pins of said press are engageable, an automatic release timing control system for automatically controlling the timing at which, when said pilot pins of said press are inserted into said pilot holes of said sheet material, said feeder is activated to temporarily release its gripping of said sheet material at a time that is dependent on the revolution speed of said part of said press and fixedly preset response times of said feeder, said automatic release timing control system comprising:

(a) a rotary encoder for detecting the revolution of said press in operation and for producing a signal indicative of the detected revolution;

(b) a response time setting device for fixedly setting response times of said release mechanism of said feeder; and (c) a control circuit for controlling the timing at which said release mechanism of said feeder temporarily releases said sheet material, said control circuit including (1) first means for receiving a signal from said rotary encoder and for calculating the rotational angle of said press in operation;

(2) second means for receiving a signal from said rotary encoder and for calculating the revolution speed of said part of said press in operation;

(3) third means for outputting a sheet release signal and a sheet grip signal to said release mechanism when the rotational angle of said press matches a predetermined rotational angle corresponding to the sheet release timing of said release mechanism and a predetermined rotational angle corresponding to the sheet grip timing of said release mechanism, respectively;

(4) fourth means for correcting the sheet release timing and the sheet grip timing based upon the present revolution speed value calculated by said second means and upon the response times set by said response time setting device;

(5) fifth means for setting a sheet release timing and a sheet grip timing for the next cycle of said press based upon the sheet release timing and the sheet grip timing corrected by said fourth means; and (6) sixth means for outputting a sheet release signal and a sheet grip signal to said release mechanism when the rotational angle of said press matches a predetermined rotational angle corresponding to the sheet release timing set by said fifth means and a predetermined rotational angle corresponding to the sheet grip timing set by said fifth means.

* * * * *